US012358743B2

(12) United States Patent
Fukumitsu

(10) Patent No.: US 12,358,743 B2
(45) Date of Patent: Jul. 15, 2025

(54) IMAGE READING DEVICE, MULTI-FEED DETECTING METHOD, AND MULTI-FEED DETECTING PROGRAM

(71) Applicant: Seiko Epson Corporation, Tokyo (JP)

(72) Inventor: Yasunori Fukumitsu, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 878 days.

(21) Appl. No.: 17/387,655

(22) Filed: Jul. 28, 2021

(65) Prior Publication Data

US 2022/0033209 A1 Feb. 3, 2022

(30) Foreign Application Priority Data

Jul. 30, 2020 (JP) ..... 2020-129540

(51) Int. Cl.
*B65H 7/12* (2006.01)
*B65H 3/06* (2006.01)

(52) U.S. Cl.
CPC ..... *B65H 7/125* (2013.01); *B65H 3/0669* (2013.01); *B65H 2553/30* (2013.01)

(58) Field of Classification Search
CPC ... B65H 7/125; B65H 3/0669; B65H 2553/30
See application file for complete search history.

(56) References Cited

U.S. PATENT DOCUMENTS

2007/0188818 A1* 8/2007 Westcott ..... H04N 1/00583 358/296
2019/0062091 A1 2/2019 Nishizaka et al.
2021/0155439 A1* 5/2021 Namiki ..... B65H 7/125

FOREIGN PATENT DOCUMENTS

JP 2017-95230 * 6/2017
JP 2019-043693 3/2019
JP 2019-123580 * 7/2019

OTHER PUBLICATIONS

Machine translation of JP 2017-95230. (Year: 2017).*
Machine translation of JP 2019-123580. (Year: 2019).*

* cited by examiner

*Primary Examiner* — Thomas A Morrison
(74) *Attorney, Agent, or Firm* — WORKMAN NYDEGGER

(57) ABSTRACT

An image reading device includes: a transport unit configured to transport a medium; an emission unit configured to emit an ultrasonic wave in accordance with a driving voltage and a reception unit configured to receive the ultrasonic wave, the emission unit and the reception unit being disposed so that a transport path for the medium transported by the transport unit is interposed therebetween; a reading unit configured to read the medium; and a control unit configured to detect presence or absence of multi-feed of the medium on the basis of a signal received by the reception unit. The image reading device is configured to switch a posture into any of a first posture or a second posture. The first posture is a posture in which the transport path is sloped relative to a mounting surface. The second posture is a posture in which an angle of the transport path relative to the mounting surface is smaller than that in the first posture. The control unit sets a first driving voltage as the driving voltage when the posture is the first posture, and sets a second driving voltage lower than the first driving voltage as the driving voltage when the posture is the second posture.

4 Claims, 9 Drawing Sheets

IMAGE READING DEVICE, MULTI-FEED DETECTING METHOD, AND MULTI-FEED DETECTING PROGRAM

The present application is based on, and claims priority from JP Application Serial Number 2020-129540, filed on Jul. 30, 2020, the disclosure of which is hereby incorporated by reference herein in its entirety.

BACKGROUND

1. Technical Field

The present disclosure relates to an image reading device, a multi-feed detecting method, and a multi-feed detecting program.

2. Related Art

There is an image reading device such as a scanner in which an ultrasonic sensor is provided to detect multi-feed of a sheet-shaped medium that a reading unit thereof reads.

Transporting a single sheet of medium is referred to as single feed, whereas transporting multiple sheets of media in a layered manner is referred to as multi-feed.

The ultrasonic sensor includes an emission unit that emits ultrasonic waves and a reception unit that receives the ultrasonic waves. These units are provided on the transport path where a medium is transported and at respective locations on one side of and the other side of the transport path. The strength of the ultrasonic wave that the reception unit receives is strong in a state where no multi-feed occurs, and is weak in a state where the multi-feed occurs. Thus, by comparing a threshold value and the strength of the ultrasonic wave that the reception unit receives, it is possible to detect the presence or absence of the multi-feed. There is a disclosed technique that adjusts the threshold value used to detect the multi-feed as described above (see JP-A-2019-43693).

The thickness of a medium and other characteristics vary from medium to medium. Thus, the strength of the ultrasonic wave that the reception unit of the ultrasonic sensor receives varies not only depending on whether it is single feed or multi-feed but also depending on types of the medium being transported. This necessitates correct detection of the presence or absence of multi-feed under individual circumstance where various types of media are transported.

SUMMARY

An image reading device includes a transport unit configured to transport a medium, an emission unit configured to emit an ultrasonic wave in accordance with a driving voltage, and a reception unit configured to receive the ultrasonic wave, the emission unit and the reception unit being disposed so that a transport path for the medium transported by the transport unit is interposed therebetween, and also includes a reading unit configured to read the medium transported by the transport unit, and a control unit configured to detect presence or absence of multi-feed of the medium on the basis of a signal received by the reception unit, in which it is possible to switch a posture into any of a first posture or a second posture, the first posture being a posture in which the transport path is sloped relative to a mounting surface where the image reading device is mounted, the second posture being a posture in which an angle of the transport path relative to the mounting surface is smaller than that in the first posture, and the control unit sets a first driving voltage as the driving voltage when the posture is the first posture, and sets a second driving voltage lower than the first driving voltage as the driving voltage when the posture is the second posture.

An image reader includes a transport unit configured to transport a medium, an emission unit configured to emit an ultrasonic wave in accordance with a driving voltage, and a reception unit configured to receive the ultrasonic wave, the emission unit and the reception unit being disposed so that a transport path for the medium transported by the transport unit is interposed therebetween, and also includes a reading unit configured to read the medium transported by the transport unit, and a control unit configured to compare a signal received by the reception unit with a predetermined threshold value to detect presence of multi-feed of the medium when the signal is less than the threshold value, in which it is possible to switch a posture into any of a first posture or a second posture, the first posture being a posture in which the transport path is sloped relative to a mounting surface where the image reading device is mounted, the second posture being a posture in which an angle of the transport path relative to the mounting surface is smaller than that in the first posture, and the control unit sets a first threshold value as the threshold value when the posture is the first posture, and sets a second threshold value greater than the first threshold value as the threshold value when the posture is the second posture.

An image reading device includes a transport unit configured to transport a medium, an emission unit configured to emit an ultrasonic wave in accordance with a driving voltage, and a reception unit configured to receive the ultrasonic wave, the emission unit and the reception unit being disposed so that a transport path for the medium transported by the transport unit is interposed therebetween, and also includes a reading unit configured to read the medium transported by the transport unit, an amplification circuit configured to amplify a signal received by the reception unit, and a control unit configured to detect presence or absence of multi-feed of the medium on the basis of the signal after the amplification, in which it is possible to switch a posture into any of a first posture or a second posture, the first posture being a posture in which the transport path is sloped relative to a mounting surface where the image reading device is mounted, the second posture being a posture in which an angle of the transport path relative to the mounting surface is smaller than that in the first posture, and the control unit sets a first amplification ratio as an amplification ratio concerning the amplification circuit when the posture is the first posture, and sets a second amplification ratio lower than the first amplification ratio as the amplification ratio concerning the amplification circuit when the posture is the second posture.

A multi-feed detecting method uses an emission unit configured to emit an ultrasonic wave and a reception unit configured to receive the ultrasonic wave, the emission unit and the reception unit being disposed at respective positions between which a transport path where a medium is transported is interposed, and includes detecting presence or absence of multi-feed of the medium on the basis of a signal received by the reception unit. A device including the transport path is configured to switch a posture into any of a first posture or a second posture, the first posture being a posture in which the transport path is sloped relative to a mounting surface where the device is mounted, the second posture being a posture in which an angle of the transport path relative to the mounting surface is smaller than that in the first posture. The method includes a setting step in which a first driving voltage is set as the driving voltage when the posture is first posture, and a second driving voltage lower than the first driving voltage is set as the driving voltage when the posture is the second posture.

A multi-feed detecting program causes a device to execute processing, the device including a transport unit configured to transport a medium, the device also including an emission unit configured to emit an ultrasonic wave in accordance with a driving voltage, the device also including a reception unit configured to receive the ultrasonic wave, the emission unit and the reception unit being disposed so that a transport path for the medium transported by the transport unit is interposed therebetween, the processing including detecting presence or absence of multi-feed of the medium on the basis of a signal received by the reception unit. The device is configured to switch a posture into any of a first posture or a second posture, the first posture being a posture in which the transport path is sloped relative to a mounting surface where the device is mounted, the second posture being a posture in which an angle of the transport path relative to the mounting surface is smaller than that in the first posture. The program causes the device to execute a setting function in which a first driving voltage is set as the driving voltage when the posture is the first posture, and a second driving voltage lower than the first driving voltage is set as the driving voltage when the posture is the second posture.

DESCRIPTION OF EXEMPLARY EMBODIMENTS

Embodiments according to the present disclosure will be described below with reference to the drawings. Note that each of the drawings is merely given as examples to describe this embodiment. Since each of the drawings is given as examples, the proportion or shape may not be correct or may be contradict to each other or some part may be omitted.

1. Device Configuration

Figure 1:
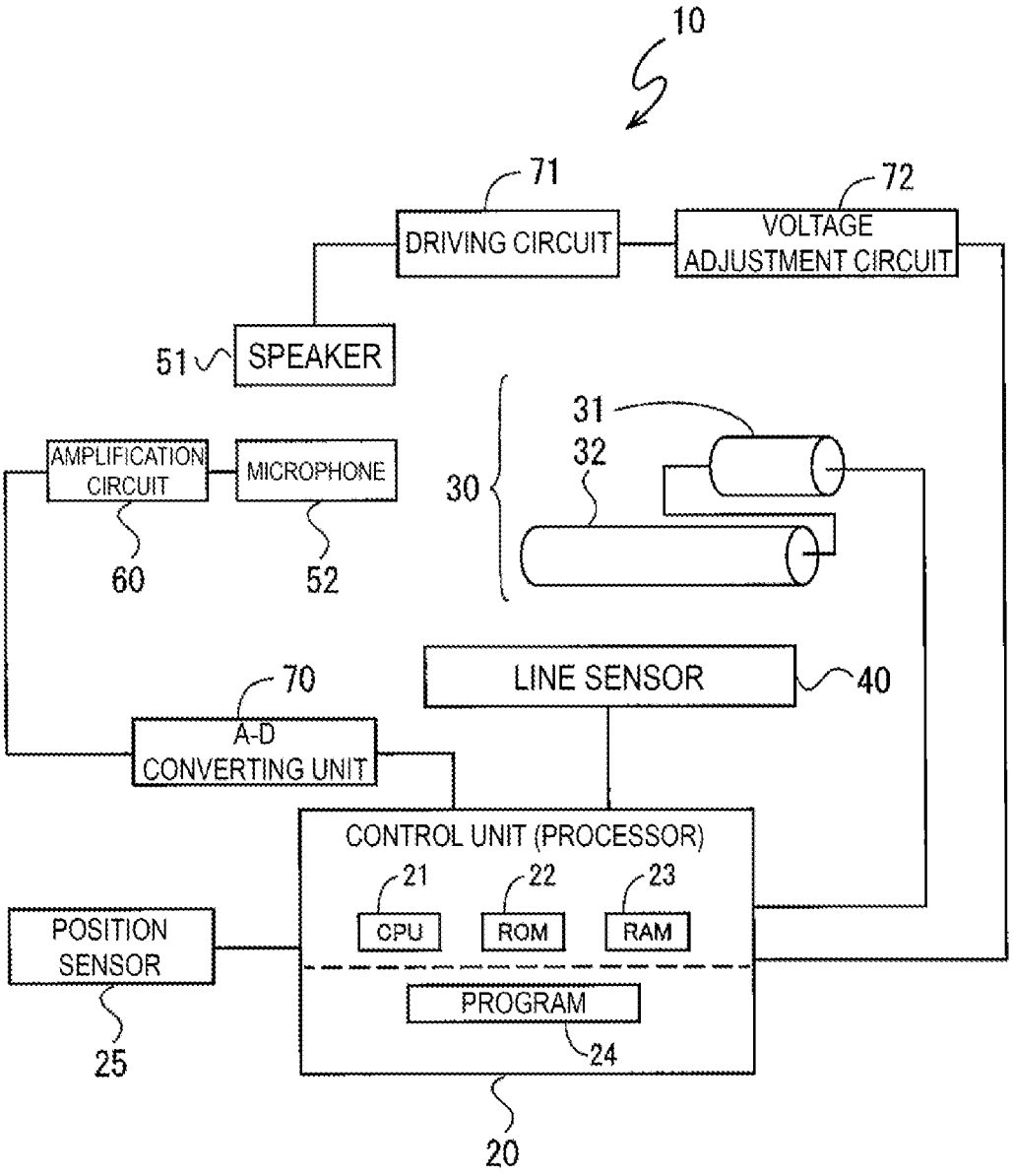
FIG. 1 is a block diagram illustrating a device configuration in a simplified manner.

FIG. 1 is a block diagram illustrating a configuration of an image reading device 10 according to this embodiment in a simplified manner. The image reading device 10 is a device that can read a medium serving as an original, and includes, for example, a scanner, a facsimile, and a multi-functional device. The image reading device 10 includes a control unit 20 corresponding to a processor. The control unit 20 is configured to include, for example, an IC including a CPU 21, an ROM 22, and an RAM 23, and other nonvolatile memories.

In the control unit 20, the CPU 21 uses an RAM 23 as a work area to execute computing processing in accordance with a program 24 held, for example, in the ROM 22 or other memories, and controls the image reading device 10. At least part of the program 24 corresponds to a multi-feed detecting program. The image reading device 10 executes a multi-feed detecting method. The processor is not limited to a single CPU. It may be possible to employ a configuration in which a plurality of CPUs or hardware circuits such as an application specific integrated circuit (ASIC) are used to perform processing or a configuration in which the CPUs and the hardware circuits cooperate with each other to perform processing.

The image reading device 10 includes a transport unit 30 configured to transport a medium and a reading unit 40 configured to read the medium transported. The reading unit 40 is, for example, a line sensor formed by arranging a plurality of photoelectric conversion elements in a one-dimensional manner. The transport unit 30 includes one or more motors 31, one or more rollers 32 that rotate with power from the motors 31, and a transport path that allows the medium transported by the rollers 32 to pass through. As for the transport path, please see the reference character 33 in FIG. 2. It can be said that the rollers 32 constitute part of the transport path. In association with the motors 31 being driven in response to a control signal from the control unit 20, the rollers 32 rotate, and the transport unit 30 transports the medium from the upstream to the downstream of the transport path. Hereinafter, the upstream and the downstream of the transport path are simply referred to as upstream and downstream, respectively. It can be said that the image reading device 10 including such a transport unit 30 is one type of a transport device that transports a medium.

The control unit 20 controls the transport unit 30 to transport the medium along the transport path. Then, the reading unit 40 outputs, to the control unit 20, a reading signal corresponding to brightness/darkness or a color of the medium that is being transported. For example, the reading unit 40 is a line sensor disposed such that the longitudinal direction thereof intersects the transport path. The control unit 20 generates image data on the basis of the reading signal of the medium by the reading unit 40, and outputs the image data or output data obtained through format conversion, to a not-illustrated external computer or the like.

A speaker 51 and a microphone 52 that are opposed to each other are disposed at respective positions between which the transport path is interposed. The microphone is referred to as a mike. The speaker 51 and the mike 52 are disposed upstream of the reading unit 40 in the transport path. Upon input of a driving signal, the speaker 51 outputs an ultrasonic wave toward the mike 52. The speaker 51 corresponds to an emission unit configured to emit an ultrasonic wave. The mike 52 outputs a signal corresponding to a sound volume of the received ultrasonic wave. The mike 52 corresponds to a reception unit configured to receive the ultrasonic wave.

An output terminal of the mike 52 is coupled to an input terminal of an amplification circuit 60. An output terminal of the amplification circuit 60 is coupled to an input terminal of an A-D converting unit 70. An output terminal of the A-D converting unit 70 is coupled to one of input terminals of the control unit 20. On the assumption that the A-D converting unit 70 constitutes part of the control unit 20, the output terminal of the amplification circuit 60 is coupled to the control unit 20. The amplification circuit 60 receives input of a signal received by and outputted by the mike 52, and amplifies it to output it. The amplification circuit 60 includes one or more amplifiers having a predetermined amplification ratio, a bandpass filter, a peak hold circuit, and the like.

After amplified by the amplification circuit 60, the signal is subjected to analog-digital conversion by the A-D converting unit 70, and then is inputted into the control unit 20. The control unit 20 makes a comparison with a predetermined threshold value used to detect multi-feed in terms of an output signal from the mike 52 during a period when the medium transported by the transport unit 30 passes between the speaker 51 and the mike 52 in the transport path. More precisely, this output signal represents a signal after the output signal has been processed by the amplification circuit 60 or the A-D converting unit 70. When the signal inputted through the A-D converting unit 70 exceeds the threshold value used to detect multi-feed, the control unit 20 detects that this is an appropriate transportation, in other words, detects that this is single feed. On the other hand, when the signal is less than or equal to the threshold value used to detect multi-feed, the control unit 20 detects that this is multi-feed. In this manner, the control unit 20 detects presence or absence of the multi-feed of the medium on the basis of the signal received by the reception unit.

A driving circuit 71 outputs a driving signal to the speaker 51. The driving circuit 71 is an emission circuit configured to output an alternating signal having a frequency of an ultrasonic wave so that the speaker 51 outputs the ultrasonic wave. A voltage adjustment circuit 72 is controlled by the controller 20, and supplies the driving circuit 71 with a driving voltage. The size of the driving signal outputted by the driving circuit 71 is substantially proportional to the driving voltage from the voltage adjustment circuit 72. The sound volume of the ultrasonic wave emitted by the speaker 51 is also substantially proportional to this driving voltage. The output of the mike 52 is also proportional to the sound volume of the ultrasonic wave emitted by the speaker 51. Thus, the control unit 20 adjusts the driving voltage supplied by the voltage adjustment circuit 72, thereby being able to adjust the output of the mike 52. The voltage adjustment circuit 72 is able to set any of a plurality of different driving voltages in accordance with an instruction of the control unit 20, and output it. Hereinafter, the driving voltage supplied by the voltage adjustment circuit 72 is simply referred to as a driving voltage.

The image reading device 10 is configured to switch a posture into any of a "first posture" or a "second posture". In the first posture, the transport path is sloped relative to a mounting surface where the image reading device 10 is mounted. In the second posture, an angle of the transport path relative to the mounting surface is smaller than that in the first posture. The mounting surface is a surface where the image reading device 10 is mounted by a user, and is typically a horizontal surface. However, it does not matter whether the mounting surface is actually horizontal or not. Hereinafter, the first posture is referred to as a "sloped posture", and the second posture is referred to as a "horizontal posture", for the purpose of facilitating understanding. Needless to say, the horizontal posture does not mean that the transport path is horizontal, and it intends to mean that the transport path is at an angle closer to being horizontal as compared to the first posture. The horizontal posture may be referred to as a substantially horizontal posture.

Figure 2:
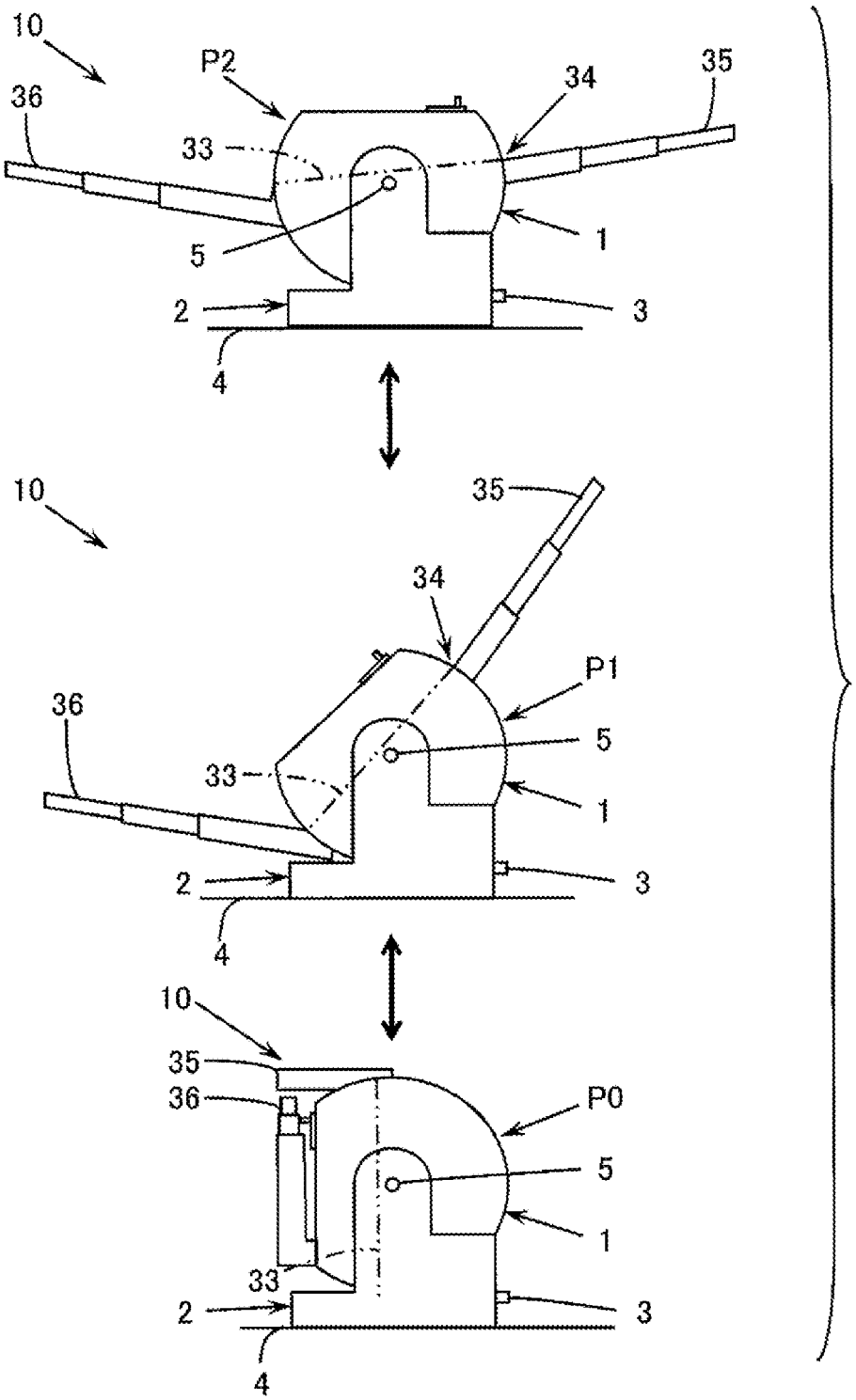
FIG. 2 is a diagram illustrating an external appearance of an image reading device that can take a plurality of postures including a sloped posture and a horizontal posture.

FIG. 2 illustrates the external appearance of the image reading device 10 that can take a plurality of postures including the slope posture P1 and the horizontal posture P2. This external appearance is illustrated as a view from the side of the image reading device 10 and is illustrated in a simplified manner. The image reading device 10 includes a main body 1, a support portion 2 of the main body 1, and a posture switching portion 3. Although illustration is not given in FIG. 2, the main body 1 includes the configuration illustrated in FIG. 1. The support portion 2 supports the main body 1 in a state of being mounted on the mounting surface 4. The posture switching portion 3 allows the main body 1 to be switched into any of a plurality of postures each having a different angle.

The upper section in FIG. 2 illustrates the image reading device 10 when the posture is the horizontal posture P2. Of the three postures illustrated in FIG. 2, the horizontal posture P2 has the closest angle of the transport path 33 to the horizontal line. In FIG. 2, the transport path 33 in the main body 1 is illustrated as a chain double-dashed line. The middle section in FIG. 2 illustrates the image reading device 10 when the posture is the sloped posture P1. In a case of the sloped posture P1, the transport path 33 is at an angle steeper than that in the horizontal posture P2. The lower section in FIG. 2 illustrates the image reading device 10 when the posture is the storage posture P0. In a case of the storage posture P0, the transport path 33 is at an angle closer to the vertical than that in the sloped posture P1. The storage posture P0 is a posture in which the image reading device 10 is not in use.

The upstream of the transport path 33 constitutes a paper feed port 34. A paper feed tray 35 extends upstream of the paper feed port 34. In other words, a medium placed on the paper feed tray 35 is pulled, by the transport unit 30, into the inside of the main body 1 from the paper feed port 34, and is transported along the transport path 33. The length of the paper feed tray 35 can expand or contract, and the paper feed tray 35 can be folded relative to the main body 1 to achieve the storage posture P0. In a case of the sloped posture P1 or the horizontal posture P2, the paper feed tray 35 may be regarded as part of the transport path 33.

A paper discharge tray 36 is provided downstream of the transport path 33. The transport unit 30 transports, further downstream, the medium that the reading unit 40 has read to emit the medium for which reading has been completed, to the paper discharge tray 36. The length of the paper discharge tray 36 can also expand or contract, and the paper discharge tray 36 can be folded relative to the main body 1 to achieve the storage posture P0.

The support portion 2 includes a rotary shaft 5 directed so as to intersect the transport path 33, and supports the main body 1 so that the main body 1 can tilt with the rotary shaft 5 being the center. A user operates the posture switching portion 3 to tilt the main body 1, thereby causing the main body 1 to be in any of the storage posture P0, the sloped posture P1, and the horizontal posture P2. For example, the posture switching portion 3 is a lever that the user can operate, and operates in conjunction with a lock mechanism that maintain an angle of the main body 1 relative to the support portion 2. The user operates the posture switching portion 3 to temporarily unlock the lock of the lock mechanism to change the angle of the main body relative to the support portion 2. Then, the user locks the lock of the lock mechanism again to cause the main body 1 to be in any of the storage posture P0, the sloped posture P1, and the horizontal posture P2. Examples are not limited to these specific examples. It is only necessary that the image reading device 10 has a structure in which a posture can be switched into any of a plurality of postures including the first posture and the second posture.

As can be understood from FIG. 2, the storage posture P0 is a posture that requires the minimum footprint for the image reading device 10 to be installed, and is suitable for storage when not in use. On the other hand, the horizontal posture P2 requires the maximum footprint. Thus, it can be said that the sloped posture P1 is a standard posture when the image reading device 10 is in use. The horizontal posture P2 is a posture suitable to read a thin paper sheet or other media for which accuracy in paper feed is more likely to reduce at the paper feed tray 35 having a steep slope. The sloped posture P1 is a posture suitable to read a specific-sized paper or thick paper sheet or other media for which paper feed can be smoothly performed at the paper feed tray 35 having a steep slope.

Thus, it can be said that each of the sloped posture P1 and the horizontal posture P2 reflects a type of media that a use wishes to transport at each situation.

2. First Embodiment

A first embodiment according to the present case will be described with reference to FIGS. 1 to 6.

Figure 3:
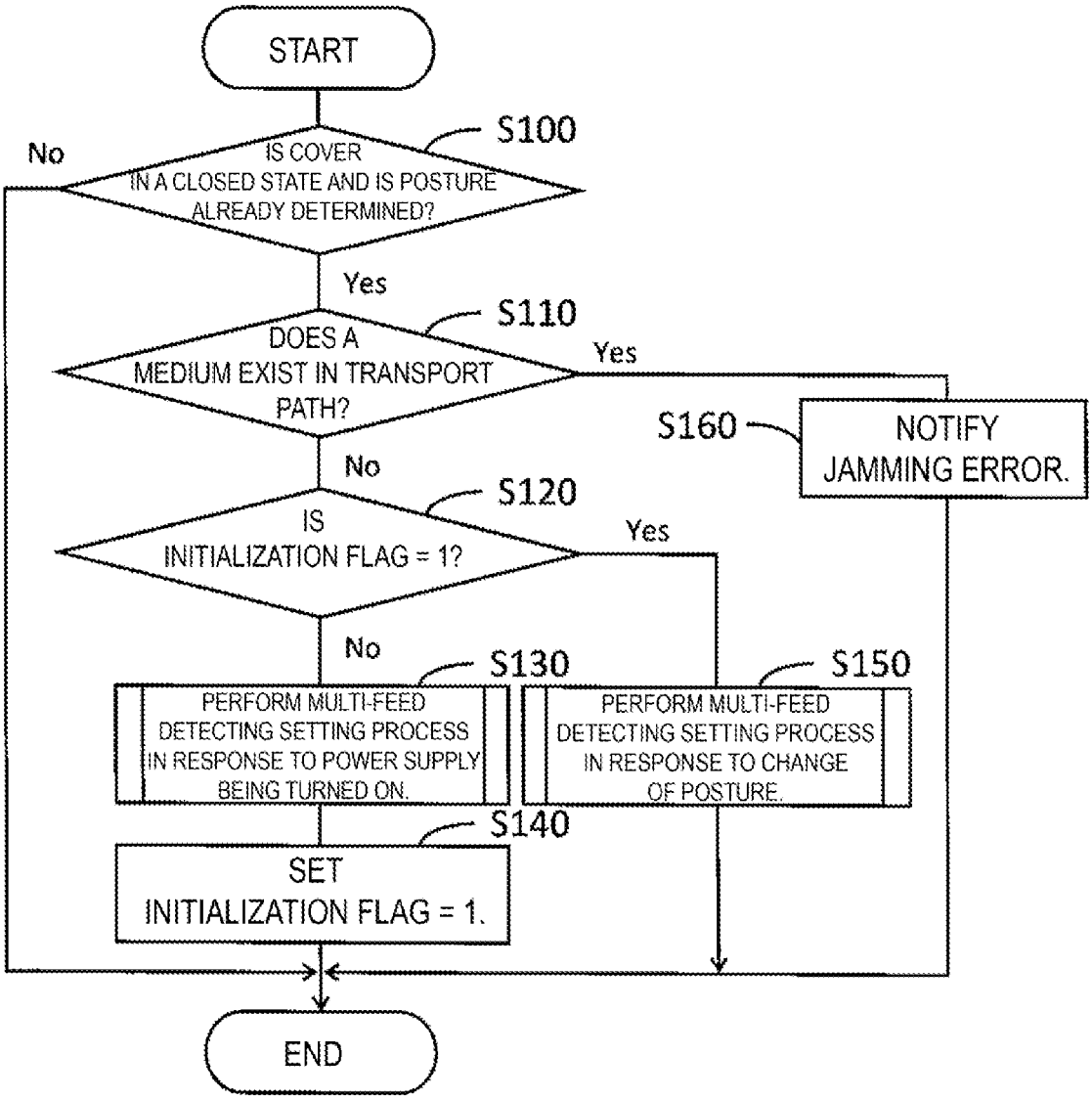
FIG. 3 is a flow chart showing a multi-feed detecting setting process.

FIG. 3 illustrates a flow chart of a multi-feed detecting setting processing executed by the control unit 20 in accordance with the program 24. Upon detecting that the image reading device 10 is turned on or upon detecting that the posture of the image reading device 10 is being changed, the control unit 20 starts this flow chart.

The image reading device 10 includes a position sensor 25 configured to detect a posture. On the basis of a signal outputted by the position sensor 25, the control unit 20 detects whether the current posture falls in the storage posture P0 or the sloped posture P1 or the horizontal posture P2, or whether the current posture falls in none of the storage posture P0, the sloped posture P1, or the horizontal posture P2. When the current posture falls in none of the storage posture P0, the sloped posture P1, or the horizontal posture P2, this means that the posture is being changed. As for the position sensor 25, it is possible to use a non-contact sensor such as an optical sensor or a magnetometer, or a contact-type sensor.

A cover is a portion of a housing of the main body 1, and a user can open or close the cover with a hand. By opening the cover, part of the transport path 33 is exposed to the outside. This allows a user to remove a medium jammed at the transport path 33, for example. The control unit 20 can determine whether the cover is opened or closed, on the basis of a signal from a not-illustrated sensor for detecting whether the cover is opened or closed.

In step S100, when the cover is closed and the posture is determined to fall in any of the storage posture P0, the sloped posture P1, and the horizontal posture P2, the control unit 20 determines "Yes" and proceeds to step S110. When the cover is not closed or the posture is not determined, "No" is determined in step S100, and the flow chart ends. Note that, in a situation where the flow chart starts in response to the power supply being turned on, it is assumed that the posture of the image reading device 10 falls in either the sloped posture P1 or the horizontal posture P2. When the flow chart ends in response to determination of "No" in step S100, it is only necessary that the control unit 20 repeats determination in step S100.

In step S110, the control unit 20 determines whether or not any medium exists in the transport path 33 other than the paper feed tray 35. When the medium exists, the flow proceeds from determination of "Yes" to step S160. On the other hand, when no medium exists in the transport path 33, the flow proceeds from determination of "No" to step S120. It is only necessary that the control unit 20 determines presence or absence of a medium in the transport path 33 on the basis of a signal from a not-illustrated sensor that detects presence or absence of the medium in the transport path 33.

In step S160, the control unit 20 notifies a user of a jamming error indicating that jamming of a medium occurs, and the flow chart ends. It is only necessary that the method of notifying the user of the error is performed through displaying on a display, which is not illustrated, or through audio output.

In step S120, the control unit 20 determines whether or not initialization flag=1 establishes. When initialization flag=0 establishes, the flow proceeds from determination of "No" to step S130. When initialization flag=1 establishes, the flow proceeds from determination of "Yes" to step S150. The initialization flag represents a flag indicating whether or not processing that is supposed to be processed is executed in response to the power supply being turned on. The initialization flag is enforcedly set to be "0" at the time of the power supply being turned on.

The control unit 20 executes a "multi-feed detecting setting processing in response to power supply being turned on" in step S130, and executes a "multi-feed detecting setting processing in response to change of posture" in step S150. Steps S130 and S150 will be described with reference to FIGS. 4 and 5. Steps S130 and S150 correspond to the setting step, and a function of a program 24 that causes a processor to execute this setting step corresponds to the setting function.

After executing step S130, the control unit 20 changes the initialization flag from "0" to "1" in step S140, and then, the flow chart ends. In addition, the control unit 20 executes step S150, and the flow chart ends.

Figure 4:
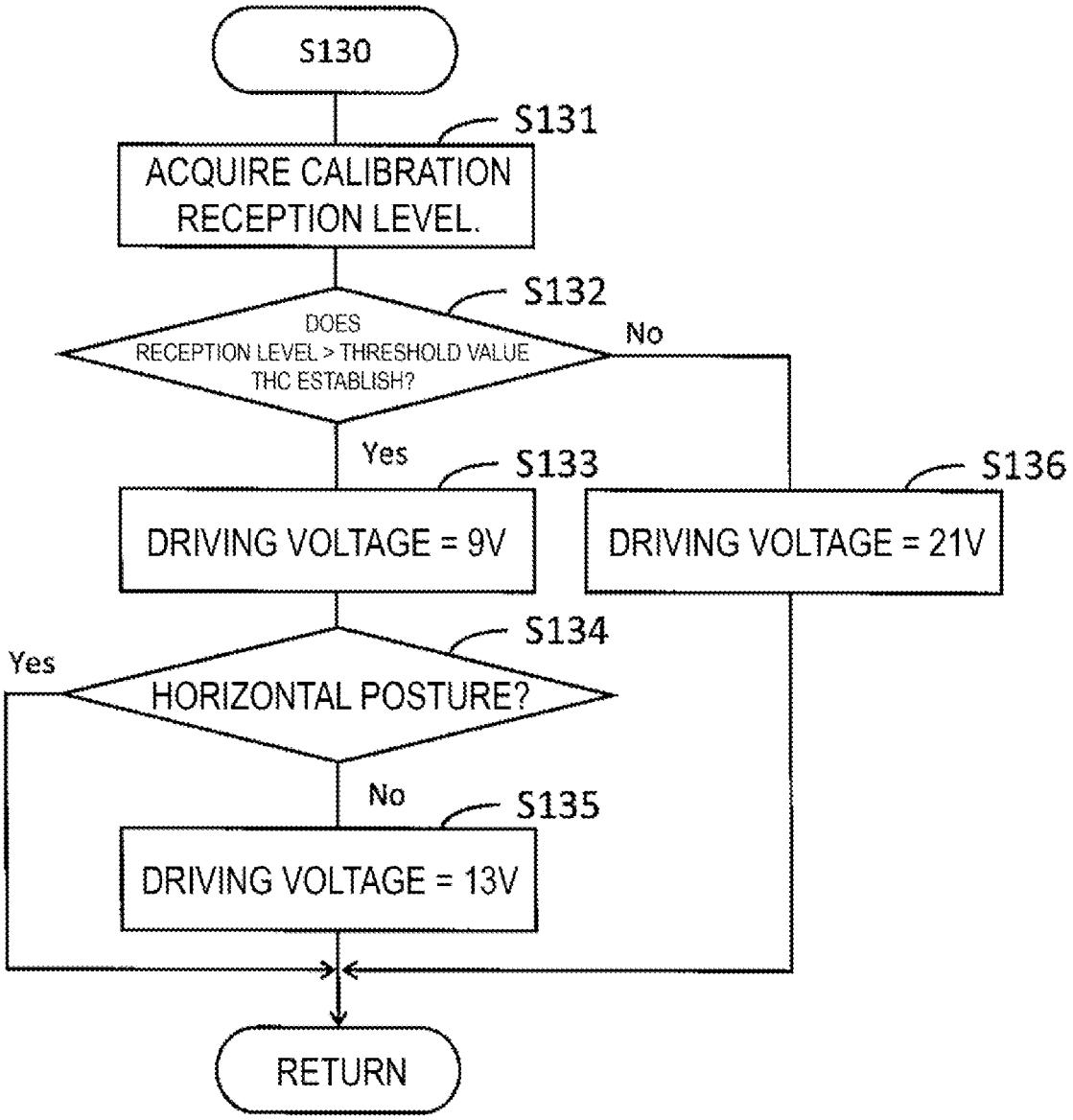
FIG. 4 is a flow chart showing details of step S130 according to a first embodiment.

FIG. 4 illustrates details of step S130 using a flow chart.

In step S131, the control unit 20 acquires a calibration reception level. A reception level of the mike 52 varies according to temperatures, humidity, barometric pressures or other environments where the image reading device 10 is disposed. The calibration as used herein means processing in which such a reception level is brought into a reasonable level necessary to detect the multi-feed. For example, the control unit 20 sets 11 V, which is a standard value of the driving voltage, in a state where no medium exists in the transport path 33, and acquires the reception level of the mike 52. The reception level of the mike 52 that the control unit 20 acquires is an output signal from the mike 52, and is a signal inputted into the control unit 20 through the A-D converting unit 70 in the illustration of FIG. 1. As described above, in step S131, the reception level of the mike 52 that the control unit 20 acquires in a state where no medium exists in the transport path 33 is the calibration reception level.

In step S131, the control unit 20 may acquire the calibration reception level a plurality of times, and in the next step S132, may treat the average of the calibration reception levels acquired a plurality of times, as the calibration reception level. Note that, in step S131, the control unit 20 causes the level of output from the amplification circuit 60 to temporarily reduce in order to acquire the calibration reception level. Specifically, when the amplification circuit 60 is configured as a multi-stage amplification circuit in which a plurality of amplifiers are coupled, the control unit 20 acquires, in step S131, a signal in the middle of amplification by the amplification circuit 60, rather than a signal outputted from the final stage of the amplification circuit 60. Alternately, when an attenuation circuit using, for example, a resistance voltage dividing circuit is provided prior to the amplification circuit 60, the control unit 20 in step S131 may make enabled the attenuation circuit of which function is usually made disabled. Then, the output of the mike 52 may be attenuated through the attenuation circuit, and is then inputted into the amplification circuit 60. In other words, in step S131, the effect of amplification by the amplification circuit 60 on the output signal from the mike 52 is substantially reduced to acquire a digital value as the output signal from the mike 52 through the A-D converting unit 70.

In step S132, the control unit 20 executes a determination processing for determining whether or not the calibration reception level exceeds a predetermined threshold value THC for calibration. When the calibration reception level exceeds the threshold value THC, the control unit 20 proceeds from determination of "Yes" to step S133. When calibration reception level does not exceed the threshold value THC, the control unit 20 proceeds from determination of "No" to step S136. The determination of "Yes" in step S132 means that, in the current situation where the image reading device 10 is disposed, the output signal of the mike 52 has strength enough to detect the multi-feed.

In step S133, the control unit 20 sets a "second driving voltage" as the driving voltage. For example, the second driving voltage is 9 V.

In step S134, the control unit 20 determines whether or not the posture of the image reading device 10 falls in the horizontal posture P2. When the posture falls in the horizontal posture P2, the control unit 20 determines "Yes" and ends step S130.

As described above, in step S130, the posture of the image reading device 10 falls in either the sloped posture P1 or the horizontal posture P2. Thus, in step S134, when the posture of the image reading device 10 fall in the horizontal posture P2, the posture falls in the sloped posture P1, and the control unit 20 proceeds from determination of "No" to step S135.

In step S135, the control unit 20 sets a "first driving voltage" greater than the second driving voltage as the driving voltage, and ends step S130. For example, the first driving voltage is 13 V.

It can be said that, with the steps S133, S134, and S135 described above, the control unit 20 sets the first driving voltage as the driving voltage when the posture of the image reading device 10 is the first posture, and sets the second driving voltage as the driving voltage when the posture is the second posture.

Note that, after determination of "Yes" in step S132, the control unit 20 may make determination of step S134, and make determination of "Yes" in step S134 to then execute step S133.

On the other hand, in step S136, the control unit 20 sets a "third driving voltage" greater than the first driving voltage as the driving voltage, and ends step S130. For example, the third driving voltage is 21 V. In other words, in step S136, under the current situation where the image reading device 10 is placed, the strength of the output signal of the mike 52 does not fall in the strength enough to detect the multi-feed. Thus, by setting the third driving voltage as the driving voltage, this strength is forcedly increased. After the third driving voltage is as the driving voltage, the control unit 20 executes step S130 in response to power supplying being turned on again, and maintains the setting of the driving voltage until determination of "Yes" in step S132.

Figure 5:
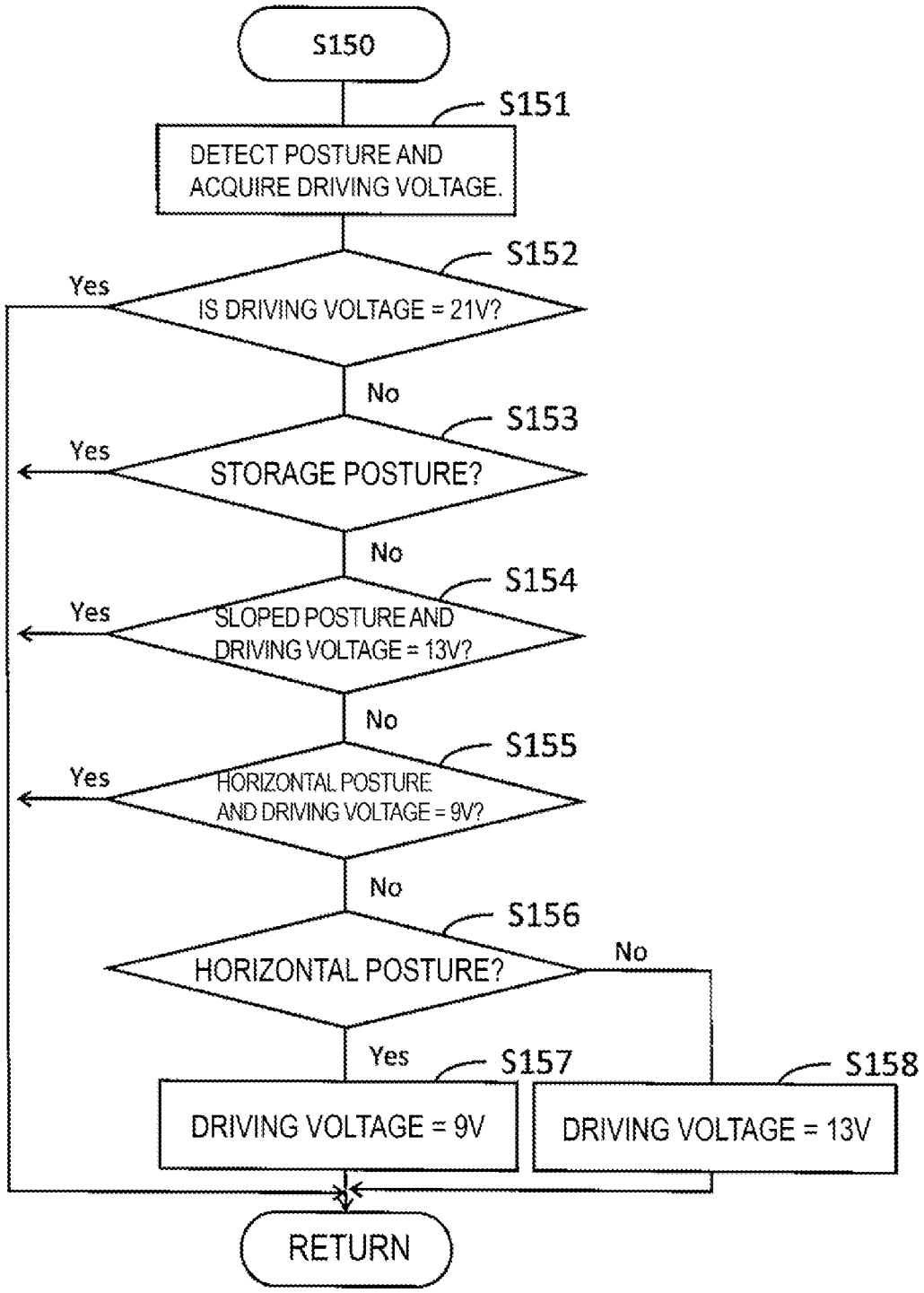
FIG. 5 is a flow chart showing details of step S150 according to the first embodiment.

FIG. 5 illustrates details of step S150 using a flow chart. As can be understood from the description so far, step S150 is executed when the power supply to the image reading device 10 is turned on and step S130 has been executed; and in this state, a user starts changing the posture of the image reading device 10 to fix the posture.

In step S151, the control unit 20 detects the current posture of the image reading device 10, and at the same time, acquires the setting of the current driving voltage. The control unit 20 makes determinations at or after step S152, on the basis of information acquired in step S151.

In step S152, the control unit 20 determines whether or not the setting of the driving voltage is 21 V in other words whether or not the setting falls in the third driving voltage. When the setting is 21 V, the control unit 20 makes a determination of "Yes" and ends step S150.

When a determination of "No" is made in step S152, the control unit 20 determines in step S153 whether or not the posture is the storage posture P0. When the posture is the storage posture P0, the control unit 20 makes a determination of "Yes" and ends step S150.

When a determination of "No" is made in step S153, the control unit 20 determines in step S154 whether or not the posture is the sloped posture P1 and the setting of the driving voltage is 13 V, in other words, is the first driving voltage. When the posture is the sloped posture P1 and the driving voltage is set to 13 V, the control unit 20 makes a determination of "Yes" in step S154 and ends step S150.

When a determination of "No" is made in step S154, the control unit 20 determines in step S155 whether or not the posture is the horizontal posture P2 and the setting of the driving voltage is 9 V, in other words, is the second driving voltage. When the posture is the horizontal posture P2 and the driving voltage is set to 9 V, the control unit 20 makes a determination of "Yes" in step S155 and ends step S150.

When a determination of "No" is made in step S155, the control unit 20 determines in step S156 whether or not the posture is the horizontal posture P2. When the posture is the horizontal posture P2, the control unit 20 makes a determination of "Yes" in step S156 and proceeds to step S157. On the other hand, when the posture is not the horizontal posture P2, in other word, the posture is the sloped posture P1, the control unit 20 makes a determination of "No" in step S156 and proceeds to step S158.

When a determination of "Yes" is made in step S156, this means that the posture is the horizontal posture P2 and the setting of the driving voltage is 13 V. Thus, the control unit 20 changes in step S157 the setting of the driving voltage from 13 V to 9 V, and then ends step S150.

On the other hand, when a determination of "No" is made in step S156, this means that the posture is the sloped posture P1 and the setting of the driving voltage is 9 V. Thus, in step S158, the control unit 20 changes the setting of the driving voltage from 9 V to 13 V, and then ends step S150.

It can be said that, with the steps S154, S155, S156, S157, and S158 described above, the control unit 20 sets the first driving voltage as the driving voltage when the posture of the image reading device 10 is the first posture, and sets the second driving voltage as the driving voltage when the posture is the second posture. Note that it may be possible that determinations in steps S152, S153, S154, and S155 are not made in the order illustrated in FIG. 5.

Figure 6:
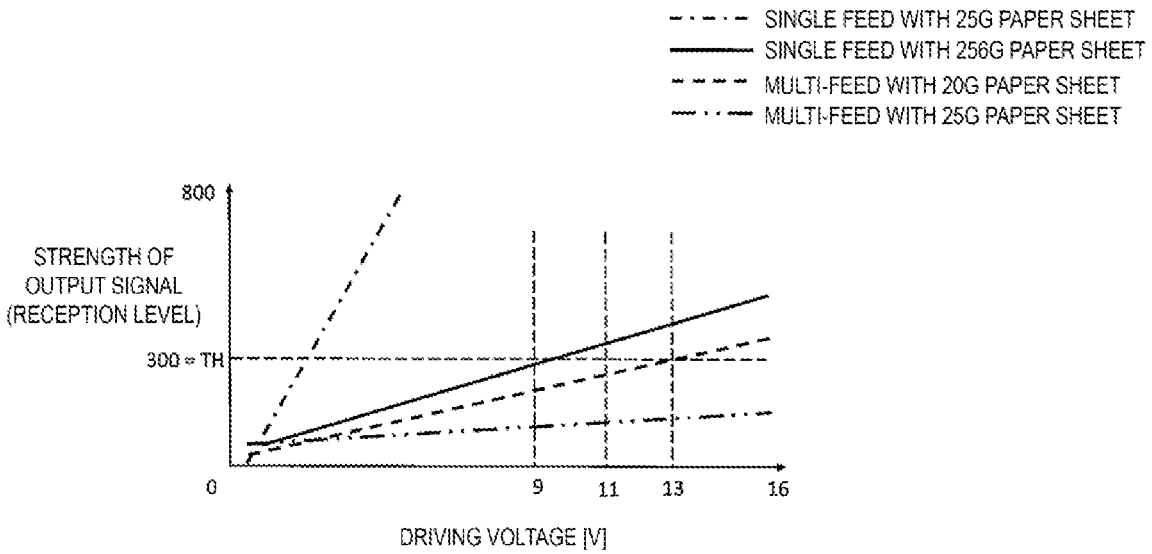
FIG. 6 is a diagram illustrating a relationship between the driving voltage and the strength of the output signal for each type of media with multi-feed and single feed.

FIG. 6 is a graph illustrating a relationship between the driving voltage and the strength of the output signal for each type of media with multi-feed and single feed. However, FIG. 6 is a graph in a case of an environment where a determination of "Yes" is made in step S132. In FIG. 6, the horizontal axis indicates the driving voltage, and the vertical axis indicates the strength of the output signal from the mike 52, in other words, indicates the reception level of the mike 52. The strength of the output signal is a digital value that the control unit 20 inputs from the A-D converting unit 70, and has a value that falls within a predetermined tonal range.

In FIG. 6, the graph indicated by the dot-and-dash line shows a relationship between the driving voltage and the strength of the output signal in a situation of single feeding of a "25 g paper sheet". In addition, in FIG. 6, the graph indicated by the solid line shows a relationship between the driving voltage and the strength of the output signal in a situation of single feeding of a "256 g paper sheet". In FIG. 6, the graph indicated by the dashed line shows a relationship between the driving voltage and the strength of the output signal in a situation where two sheets of "20 g paper sheets" are multi-fed in a layered manner. In FIG. 6, the graph indicated by the chain double-dashed line shows a relationship between the driving voltage and the strength of the output signal in a situation where two sheets of "25 g paper sheets" are multi-fed in a layered manner.

The 20 g, 25 g, or 256 g as used here indicates a basis weight of a paper sheet. The basis weight represents a weight per square meter, and means that the thickness increases with increase in the basis weight. Thus, the 256 g paper sheet belongs to a type of thick paper in a relative manner, and is transported with the image reading device 10 of which posture is set to the sloped posture P1. On the other hand, the 20 g paper sheet and the 25 g paper sheet belong to a type of thin paper in a relative manner, and is transported with the image reading device 10 of which posture is set to the horizontal posture P2. The thick paper may be referred to as a first medium, and the thin paper may be referred to as a second medium.

From any of the graphs in FIG. 6, it can be understood that the strength of the output signal increases with increase in the driving voltage. Even with the same single feed, the strength of the output signal at the time of single feed with the 25 g paper sheet is significantly greater than the strength of the output signal at the time of single feed with the 256 g paper sheet. The strength of the output signal at the time of single feed with the 256 g paper sheet is closer to the strength of the output signal at the time of multi-feed with the 20 g paper sheet, rather than to the strength of the output signal at the time of single feed with the 25 g paper sheet. Note that the strength of the output signal at the time of multi-feed with the 256 g paper sheet stays at values close to substantially zero, and hence, is not illustrated in FIG. 6.

In FIG. 6, the strength "300" of the output signal is a specific example of the threshold value TH used to detect the multi-feed. In FIG. 6, at the time of driving voltage=11 V, the strength of the output signal at the time of single feed with the 256 g paper sheet and the strength of the output signal at the time of multi-feed with the 20 g paper sheet can be distinguished at the threshold value TH. However, it cannot be said that, at the time of driving voltage=11 V, a difference between the threshold value TH and the strength of the output signal at the time of single feed with the 256 g paper sheet is enough, or at the time of driving voltage=11 V, a difference between the threshold value TH and the strength of the output signal at the time of multi-feed with the 20 g paper sheet is enough. Thus, given the variations in the reception level of the mike 52 or errors in measurement or the like, results of detection of the multi-feed are not always correct when the multi-feed is detected using the threshold value TH in a situation where a type of a medium is not known.

For such a problem, when the posture of the image reading device 10 is the sloped posture P1, it can be said that a medium to be transported is a thick paper sheet or other types of media of which basis weight is relatively large. Thus, the control unit 20 sets 13 V as the driving voltage. In addition, when the posture of the image reading device 10 is the horizontal posture P2, it can be said that a medium to be transported is a thin paper sheet or other types of media of which basis weight is relatively small. Thus, the control unit 20 sets 9 V as the driving voltage. In FIG. 6, by setting the driving voltage=13 V, the strength of the output signal at the time of single feed with the 256 g paper sheet largely exceeds the threshold value TH. Thus, in the sloped posture P1, it is possible to correctly detect presence or absence of the multi-feed of a medium. In addition, in FIG. 6, by setting the driving voltage=9 V, the strength of the output signal at the time of multi-feed with the 20 g paper sheet is significantly lower than the threshold value TH. Thus, in the horizontal posture P2, it is possible to correctly detect presence or absence of the multi-feed of a medium.

3. Second Embodiment

In a second embodiment, matters common to those in the first embodiment will not be repeated. In the first embodiment, the driving voltage is switched in accordance with the posture of the image reading device 10. However, in the second embodiment, the threshold value used to detect multi-feed is switched in accordance with the posture of the image reading device 10.

Figure 7:
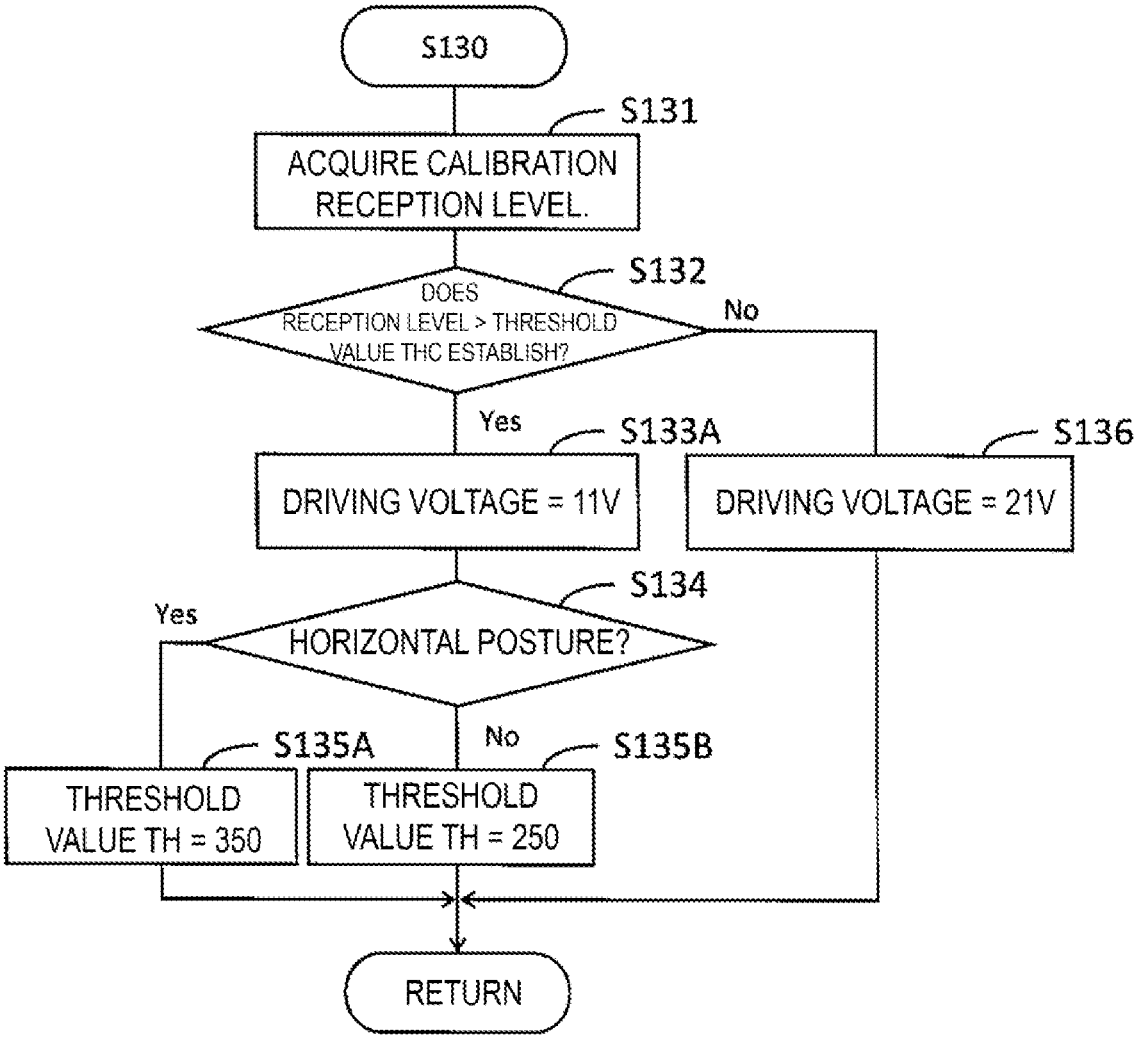
FIG. 7 is a flow chart showing details of step S130 according to a second embodiment.

FIG. 7 illustrates details of step S130 according to the second embodiment using a flow chart. When FIG. 7 and FIG. 4 are compared, FIG. 7 differs from FIG. 4 in that step S133A is executed in place of step S133, and step S135A or step S135B is executed in accordance with the determination of step S134.

After the determination of "Yes" in step S132, in step S133A, the control unit 20 sets, for example, 11 V that is a standard value described above, as the driving voltage. After step S133A, the control unit 20 makes a determination of step S134. When the posture of the image reading device 10 is the horizontal posture P2, a determination of "Yes" is made and the flow proceeds to step S135A. When the posture is the sloped posture P1, a determination of "No" is made and the flow proceeds to step S135B.

In step S135B, the control unit 20 sets the "first threshold value" as the threshold value TH for multi-feed detection, and ends step S130. As one example, the first threshold value is "250". On the other hand, in step S135A, the control unit 20 sets the "second threshold value" greater than the first threshold value as the threshold value TH, and ends step S130. As one example, the second threshold value is "350".

Figure 8:
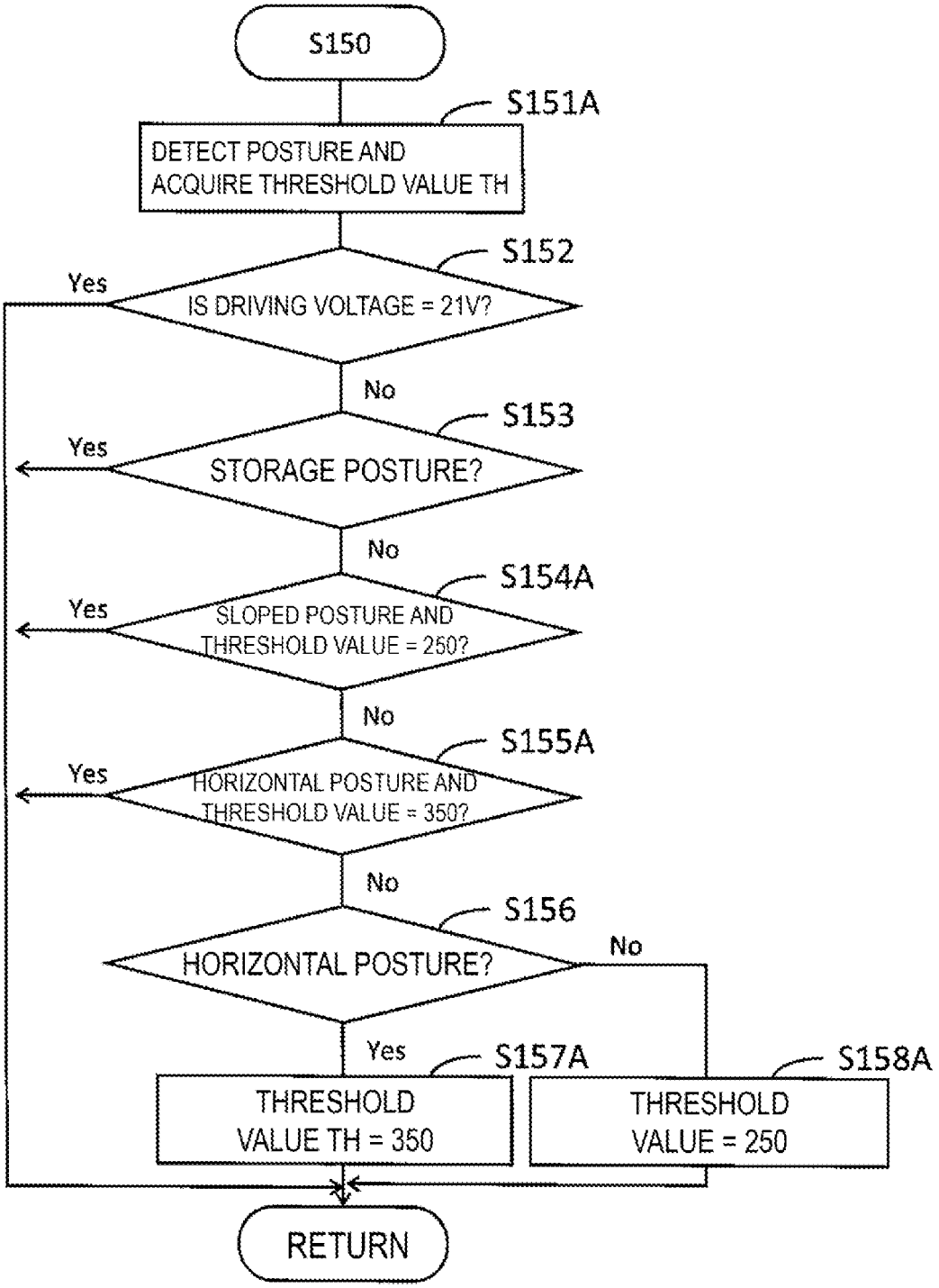
FIG. 8 is a flow chart showing details of step S150 according to the second embodiment.

FIG. 8 illustrates details of step S150 according to the second embodiment using a flow chart. When FIG. 8 and FIG. 5 are compared, FIG. 8 differs from FIG. 5 in that steps S151A, S154A, S155A, S157A, and S158A are executed in place of steps S151, S154, S155, S157, and S158.

In step S151A, the control unit 20 detects the current posture of the image reading device 10, and acquires the current setting of the threshold value TH. The control unit 20 makes determinations in and after step S152 on the basis of the information acquired in step S151A. When a determination of "No" is made in step S153, the control unit 20 determines in step S154A whether or not the posture is the sloped posture P1 and the setting of the threshold value TH is "250", in other words, is the first threshold value. When the posture is the sloped posture P1 and the threshold value Th is set to "250", the control unit 20 makes a determination of "Yes" in step S154A and ends step S150.

When the determination of "No" is made in step S154A, the control unit 20 determines in step S155A whether or not the posture is the horizontal posture P2 and the setting of the threshold value TH is "350", in other words, is the second threshold value. When the posture is the horizontal posture P2 and the threshold value TH is set to "350", the control unit 20 makes a determination of "Yes" in step S155A and ends step S150.

When the determination of "No" is made in the step S155A, the control unit 20 makes a determination of step S156. When the posture of the image reading device 10 is the horizontal posture P2, the control unit 20 makes a determination of "Yes" and proceeds to step S157A. When the posture is the sloped posture P1, the control unit 20 makes a determination of "No" and proceeds to step S158A.

Making a determination of "Yes" in step S156 means that the posture is the horizontal posture P2 and the threshold value TH is set to "250". Thus, in step S157A, the control unit 20 changes the setting of the threshold value TH from "250" to "350", and then, ends step S150. On the other hand, making a determination of "No" in step S156 means that the posture is the sloped posture P1 and the threshold value TH is set to "350". Thus, in step S158A, the control unit 20 changes the setting of the threshold value TH from "350" to "250", and then, ends step S150.

With the steps S134, S135A, and S135B in FIG. 7 or the steps S154A, S155A, S156, S157A, and S158A in FIG. 8 as described above, it can be said that the control unit 20 sets the first threshold value as the threshold value TH when the posture of the image reading device 10 is the first posture, and sets the second threshold value as the threshold value TH when the posture is the second posture.

Figure 9:
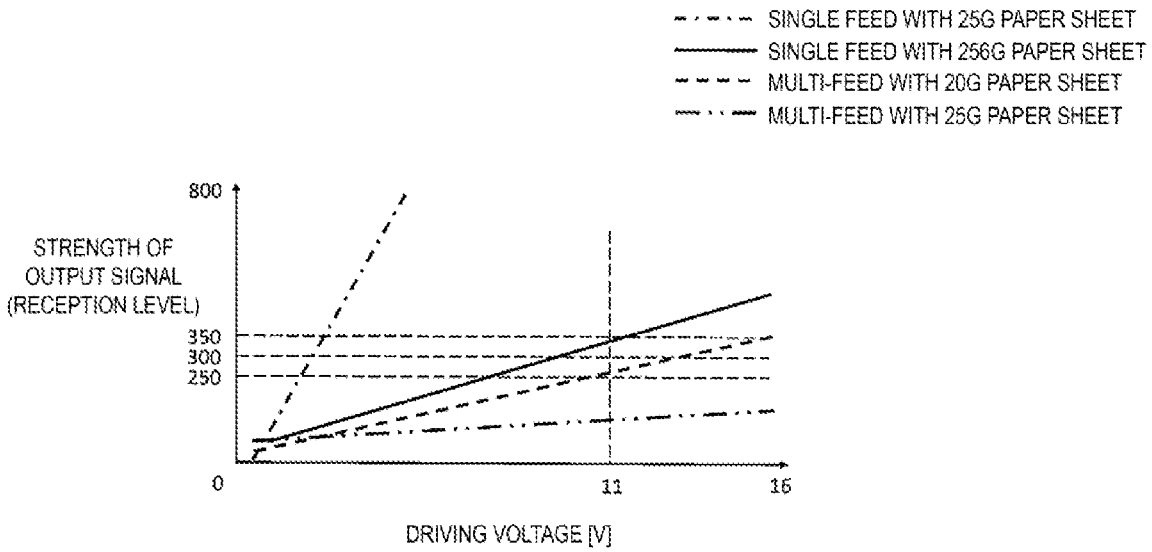
FIG. 9 is a diagram illustrating a relationship between the driving voltage and the strength of the output signal for each type of media with multi-feed and single feed, together with a plurality of threshold values.

FIG. 9 illustrates individual graphs completely similar to those in FIG. 6, and also illustrates a plurality of threshold values that can be set as threshold values TH. As described above, in the second embodiment, the control unit 20 sets "250" as the threshold value TH when the posture of the image reading device 10 is the sloped posture P1, and sets "350" as the threshold value TH when the posture is the horizontal posture P2. From FIG. 9, in a case of the threshold value TH=250, the strength of the output signal at the time of single feed with the 256 g paper sheet at the time of the driving voltage=11 V significantly exceeds the threshold value TH. Thus, in the sloped posture P1, it is possible to correctly detect presence or absence of the multi-feed of a medium. In addition, from FIG. 9, in a case of the threshold value TH=350, the strength of the output signal at the time of multi-feed with the 20 g paper sheet at the time of the driving voltage=11 V is significantly lower than the threshold value TH. Thus, in the horizontal posture P2, it is possible to correctly detect presence or absence of the multi-feed of a medium.

4. Third Embodiment

In a third embodiment, matters common to those in the first or second embodiment will not be repeated. In the description so far, it is assumed that the amplification ratio of the amplification circuit 60 is constant except for a situation where the amplification function temporarily reduces for the purpose of step S131. In contrast, in the third embodiment, the control 20 can adjust the amplification ratio concerning the amplification circuit 60. For example, the amplification circuit 60 includes a plurality of amplifiers each having a predetermined amplification ratio. In addition, for example, the control unit 20 switches between using and not-using a portion of the amplifiers within the amplification circuit 60 to adjust the amplification ratio of the amplification circuit 60 for the output signal of the mike 52. Here, when a predetermined amplification ratio concerning the amplification circuit 60 is called a "first amplification ratio", a predetermined amplification ratio concerning the amplification circuit 60 that is lower than the first amplification ratio is referred to as a "second amplification ratio".

In the third embodiment, the control unit 20 sets the first amplification ratio as the amplification ratio concerning the amplification circuit 60 when the posture of the image reading device 10 is the sloped posture P1, and sets the second amplification ratio as the amplification ratio concerning the amplification circuit 60 when the posture is the horizontal posture P2.

The third embodiment as described above will be briefly described with reference to FIGS. 7 and 8 concerning the second embodiment. In step S135A in the third embodiment, it is only necessary that the control unit 20 sets the second amplification ratio as the amplification ratio concerning the amplification circuit 60 while maintaining, for example, "300" as the threshold value TH for multi-feed detection, and ends step S130. In addition, in step S135B, the first amplification ratio is set as the amplification ratio concerning the amplification circuit 60 while "300" is being maintained as the threshold value TH, and step S130 ends.

Furthermore, in the flow of steps S154A, S155A, S156, S157A, and S158A in the third embodiment, it is only necessary that, while maintaining "300" as the threshold value TH, the control unit 20 controls the amplification ratio concerning the amplification circuit 60 so as to be the first amplification ratio at the time of the sloped posture P1, and be the second amplification ratio at the time of the horizontal posture P2. With the third embodiment as described above, in a case of the sloped posture P1 in which a thick paper sheet or the like is transported, the strength of the output signal of the mike 52, which is to be compared with the threshold value TH, is largely increased. This makes it possible to correctly detect presence or absence of the multi-feed of a medium in the sloped posture P1. In addition, in a case of the horizontal posture P2 in which a thin paper sheet or the like is transported, the strength of the output signal of the mike 52, which is to be compared with the threshold value TH, is increased such that the degree of the increase is not greater than that at the time of the sloped posture P1. This makes it possible to correctly detect presence or absence of the multi-feed of a medium in the horizontal posture P2.

5. Summary and Modification Examples

As described above, the image reading device 10 includes: the transport unit 30 configured to transport a medium; the emission unit configured to emit an ultrasonic wave in accordance with a driving voltage and the reception unit configured to receive the ultrasonic wave, the emission unit and the reception unit being disposed at respective positions between which the transport path 33 for the medium by the transport unit 30 is interposed; the reading unit 40 configured to read the medium transported by the transport unit 33; and the control unit 20 configured to detect presence or absence of multi-feed of the medium on the basis of a signal received by the reception unit. In addition, the image reading device 10 can switch a posture into any of the first posture or the second posture. In the first posture, the transport path 33 is sloped relative to the mounting surface 4 where the image reading device 10 is mounted. In the second posture, an angle of the transport path 33 relative to the mounting surface 4 is smaller than that in the first posture.

In a case of the first embodiment, the control unit 20 sets the first driving voltage as the driving voltage when the posture is the first posture, and sets the second driving voltage lower than the first driving voltage as the driving voltage when the posture is the second posture.

The control unit 20 compares a signal received by the reception unit with a predetermined threshold value TH, and detects that the multi-feed of a medium exists when the signal is less than the threshold value TH.

Furthermore, in a case of the second embodiment, the control unit 20 sets the first threshold value as the threshold value TH when the posture is the first posture, and sets the second threshold value greater than the first threshold value as the threshold value TH when the posture is the second posture.

The amplification circuit 60 amplifies a signal received by the reception unit. The control unit 20 detects presence or absence of the multi-feed of a medium on the basis of the signal after the amplification.

Furthermore, in a case of the third embodiment, the control unit 20 sets the first amplification ratio as the amplification ratio concerning the amplification circuit 60 when the posture is the first posture, and sets the second amplification ratio lower than the first amplification ratio as the amplification ratio concerning the amplification circuit 60 when the posture is the second posture.

With each of these embodiments, when the posture of the image reading device 10 is the first posture, any of the settings of the driving voltage, the threshold value TH, and the amplification ratio concerning multi-feed detection is set so as to be suitable for a thick paper sheet or the like that is expected to be transported in a state of the first posture. In addition, when the posture is the second posture, any of the settings of the driving voltage, the threshold voltage TH, and the amplification ratio is set to be suitable for a thin paper sheet or the like that is expected to be transported in the second posture. This makes it possible to appropriately detect presence or absence of the multi-feed in individual situations where various types of media are transported.

In addition to the image reading device 10, this embodiment also discloses various categories of disclosure including a multi-feed detecting method and a multi-feed detecting program.

For example, the multi-feed detecting method uses an emission unit configured to emit an ultrasonic wave in accordance with a driving voltage and a reception unit configured to receive the ultrasonic wave, the emission unit and the reception unit being disposed at respective positions between which the transport path 33 where a medium is transported is interposed, and includes detecting presence or absence of multi-feed of the medium on the basis of a signal received by the reception unit. The method includes a setting step in which the first driving voltage is set as the driving voltage when the posture of the device including the transport path 33 is the first posture, and the second driving voltage lower than the first driving voltage is set as the driving voltage when the posture is the second posture.

In addition, the multi-feed detecting program causes a device to execute processing. The device includes the transport unit 30 configured to transport a medium. The device also includes an emission unit configured to emit an ultrasonic wave in accordance with a driving voltage. The device also includes a reception unit configured to receive the ultrasonic wave. The emission unit and the reception unit are disposed at respective positions between which the transport path 33 for the medium by the transport unit 30 is interposed. The processing includes detecting presence or absence of multi-feed of the medium on the basis of a signal received by the reception unit. The device is caused to execute a setting function in which the first driving voltage is set as the driving voltage when the posture of the device is the first posture, and the second driving voltage lower than the first driving voltage is set as the driving voltage when the posture is the second posture.

Needless to say, the methods and programs corresponding to the second embodiment and the third embodiment can also be each regarded as the disclosure.

With this embodiment, when power supply to the image reading device 10 is turned on, the control unit 20 executes the determination processing for determining whether or not a signal (calibration reception level) received by the reception unit in a state where no medium exists in the transport path 33 exceeds the threshold value THC for calibration. In the first embodiment, the control unit 20 sets the third driving voltage greater than the first driving voltage as the driving voltage when determining, in the determination processing, that the signal does not exceed the threshold value THC, and sets a driving voltage corresponding to the posture when determining, in the determination processing, that the signal exceeds the threshold value THC.

With the configuration described above, the calibration for setting the third driving voltage as the driving voltage is performed when the calibration reception level does not exceed the threshold value THC. This makes it possible to appropriately detect the multi-feed regardless of environments where the image reading device 10 is placed.

It should be noted that, in the second embodiment, when determining, in the determination processing, that the signal does not exceed the threshold value THC, the control unit 20 sets the third driving voltage as the driving voltage. In addition, when determining, in the determination processing, that the signal exceeds the threshold value THC, the control unit 20 sets the threshold value TH corresponding to the posture.

In the third embodiment, when determining, in the determination processing, that the signal does not exceed the threshold value THC, the control unit 20 sets the third driving voltage as the driving voltage. In addition, when determining, in the determination processing, that the signal exceeds the threshold value THC, the control unit 20 sets an amplification ratio corresponding to the posture.

Here, a modification example of the second embodiment will be described.

When the posture of the image reading device 10 is the horizontal posture P2, it is expected that a thin paper sheet is transported as a medium. A leading edge area of a thin paper sheet including the leading edge directed downstream flaps and is unstable for a certain period of time since the start of transportation of this paper sheet from the paper feed tray 35. The reception level of the mike 52 is more likely to decrease in this period of time. In view of such a circumstance, during a period of time (specific period of time) until a predetermined area of a medium including the leading edge of the medium passes through the positions of the emission unit and the reception unit in the transport path 33, the control unit 20 may set, as the threshold value TH, a "third threshold value" that is greater than the first threshold value and is lower than the second threshold value when the posture is the second posture. Note that the positions of the emission unit and the reception unit in the transport path 33 include a position for detecting presence or absence of the multi-feed.

In other words, in step S130 or step S150, as the posture of the image reading device 10 is the horizontal posture P2, the control unit 20 sets the threshold value TH=350. Then, only in the specific period of time in the period of time for transporting the medium, the setting of the threshold value TH is changed into the third threshold value to detect the multi-feed. With reference to FIG. 9, the third threshold value is set, for example, to "300". For example, it is only necessary for the control unit 20 to recognize that the specific period of time is several seconds determined in advance as a period of time from the start of transportation from the paper feed tray 35 until the predetermined area of a medium including the leading edge of the medium passes through the positions of the emission unit and the reception unit in the transport path 33. Alternately, the control unit 20 may recognize that the specific period of time is a period of time from the start of transportation from the paper feed tray 35 until the leading edge of the medium reaches a predetermined roller disposed downstream of the positions of the emission unit and the reception unit in the transport path 33. With the modification example of the second embodiment as described above, it is possible to further improve the accuracy in multi-feed detection targeted at the predetermined area of a medium transported at the time of the horizontal posture P2.

Furthermore, as one of the present embodiments, it may be possible to employ a configuration in which the control unit 20 detects presence or absence of a medium in the transport path 33 on the basis of a signal received by the reception unit, and performs a setting corresponding to the posture when no medium exists in the transport path 33. In other words, the control unit 20 may use the speaker 51 and the mike 52, which are ultrasonic sensors, as a sensor for making a determination in step S110 to determine whether or not a medium exists in the transport path 33, on the basis of the strength of the output signal from the mike 52. In addition, as illustrated in FIG. 3, by making the determination in step S110 and then executing step S130, it is possible to reliably perform calibration in a state where no medium exists in the transport path 33.

This embodiment can be applied not only to the image reading device 10 that reads a medium serving as the original but also to a general transport device that can switch a posture into the first posture or the second posture to transport a medium. The device to which the present embodiment can be applied includes a device that cannot take the storage posture P0.

The specific values of the driving voltage and the threshold value that have been described are merely examples. This embodiment should not be interpreted to be limited to these specific values.

What is claimed is:

1. An image reading device comprising:

a transport roller unit configured to transport a medium;

an emission speaker unit configured to emit an ultrasonic wave in accordance with a driving voltage and a reception microphone unit configured to receive the ultrasonic wave, the emission speaker unit and the reception microphone unit being disposed so that a transport path for the medium transported by the transport roller unit is interposed therebetween;

a reading unit configured to read the medium transported by the transport roller unit; and a control unit configured to detect presence or absence of multi-feed of the medium on a basis of a signal received by the reception microphone unit, wherein the image reading device is configured to switch a posture into any of a first posture or a second posture, the first posture being a posture in which the transport path is sloped relative to a mounting surface where the image reading device is mounted, the second posture being a posture in which an angle of the transport path relative to the mounting surface is smaller than that in the first posture, the control unit sets a first driving voltage as the driving voltage when the posture is the first posture, and sets a second driving voltage lower than the first driving voltage as the driving voltage when the posture is the second posture, when power supply to the image reading device is turned on, the control unit executes a determination processing for determining whether a signal received by the reception microphone unit in a state where no medium exists in the transport path exceeds a threshold value for calibration, the control unit sets a third driving voltage greater than the first driving voltage as the driving voltage when determining, in the determination processing, that the signal does not exceed the threshold value for calibration, and the control unit sets the driving voltage corresponding to the posture when determining, in the determination processing, that the signal exceeds the threshold value for calibration.

2. The image reading device according to claim 1, wherein the control unit detects presence or absence of the medium in the transport path on a basis of a signal received by the reception microphone unit, and performs a setting corresponding to the posture when no medium exists in the transport path.

3. A multi-feed detecting method in an image reading device using an emission speaker unit configured to emit an ultrasonic wave in accordance with a driving voltage and a reception microphone unit configured to receive the ultrasonic wave, the emission speaker unit and the reception microphone unit being disposed so that a transport path for a medium transported by a transport roller unit is interposed therebetween, and the method including detecting presence or absence of multi-feed of the medium on a basis of a signal received by the reception microphone unit, wherein the image reading device including the transport path is configured to switch a posture into any of a first posture or a second posture, the first posture being a posture in which the transport path is sloped relative to a mounting surface where the device is mounted, the second posture being a posture in which an angle of the transport path relative to the mounting surface is smaller than that in the first posture, and the method includes a setting step in which a first driving voltage is set as the driving voltage when the posture is the first posture, and a second driving voltage lower than the first driving voltage is set as the driving voltage when the posture is the second posture, wherein when power supply to the image reading device is turned on, a control unit of the image reading device executes a determination processing for determining whether a signal received by the reception microphone unit in a state where no medium exists in the transport path exceeds a threshold value for calibration, the control unit sets a third driving voltage greater than the first driving voltage as the driving voltage when determining, in the determination processing, that the signal does not exceed the threshold value for calibration, and the control unit sets the driving voltage corresponding to the posture when determining, in the determination processing, that the signal exceeds the threshold value for calibration.

4. A non-transitory computer-readable storage medium storing a multi-feed detecting program that causes a device to execute processing, the device including a transport roller unit configured to transport a medium, an emission speaker unit configured to emit an ultrasonic wave in accordance with a driving voltage, and a reception microphone unit configured to receive the ultrasonic wave, the emission speaker unit and the reception microphone unit being disposed so that a transport path for the medium transported by the transport roller unit is interposed therebetween, the processing including detecting presence or absence of multi-feed of the medium on a basis of a signal received by the reception microphone unit, wherein the device is configured to switch a posture into any of a first posture or a second posture, the first posture being a posture in which the transport path is sloped relative to a mounting surface where the device is mounted, the second posture being a posture in which an angle of the transport path relative to the mounting surface is smaller than that in the first posture, the program causes the device to execute a setting function of setting a first driving voltage as the driving voltage when the posture is the first posture, and setting a second driving voltage lower than the first driving voltage as the driving voltage when the posture is the second posture, when power supply to the device is turned on, a control unit of the device executes a determination processing for determining whether a signal received by the reception microphone unit in a state where no medium exists in the transport path exceeds a threshold value for calibration, the control unit sets a third driving voltage greater than the first driving voltage as the driving voltage when determining, in the determination processing, that the signal does not exceed the threshold value for calibration, and the control unit sets the driving voltage corresponding to the posture when determining, in the determination processing, that the signal exceeds the threshold value for calibration.

* * * * *